US005171047A

United States Patent [19]

Korb et al.

[11] Patent Number: 5,171,047

[45] Date of Patent: Dec. 15, 1992

[54] DRIVE-ROD LOCK

[75] Inventors: Klaus Korb, Ratingen; Ralf Döring, Heiligenhaus, both of Fed. Rep. of Germany

[73] Assignee: Carl Fuhr GmbH & Co., Heiligenhaus, Fed. Rep. of Germany

[21] Appl. No.: 562,487

[22] Filed: Aug. 3, 1990

[30] Foreign Application Priority Data

Aug. 16, 1989 [DE] Fed. Rep. of Germany ..... 8909801

[51] Int. Cl.[5] ..... E05C 9/12

[52] U.S. Cl. ..... 292/39; 292/51

[58] Field of Search ..... 292/39, 51, 45, 25

[56] References Cited

U.S. PATENT DOCUMENTS

| | | | |
|---|---|---|---|
| 961,327 | 6/1910 | Voight | 292/DIG. 49 |
| 1,131,247 | 3/1915 | Kiekert | 292/51 |
| 4,962,653 | 10/1990 | Kaup | 292/39 |
| 4,973,091 | 11/1990 | Paulson et al. | 292/216 |
| 5,058,938 | 10/1991 | Döring et al. | 292/45 |

FOREIGN PATENT DOCUMENTS

| | | | |
|---|---|---|---|
| 2436239 | 5/1980 | Fed. Rep. of Germany | 292/142 |
| 1331434 | 5/1963 | France | 292/142 |

*Primary Examiner*—Renee S. Luebke

*Assistant Examiner*—D. Boucher

*Attorney, Agent, or Firm*—Martin A. Farber

[57] ABSTRACT

A drive-rod lock having drive-rods which can be displaced by turning the door handle or the like, and a nut associated with the door handle, which nut, held in its basic central position, can be swung out of said position against spring action in the opposite direction, the lock case bearing a cuff rail which continues beyond the lock case into freely extending cuff rail sections (1') behind which there are guided the drive-rods (48) which so control additional locking members, for instance swivel bolts arranged in the region of the cuff rail sections (1'). These locking members can enter into mating locking parts on the frame side, both as a result of the turning of the door handle and of the releasing of at least one force accumulator (55) acting on the drive-rods, the releasing of the force accumulator (55) being effected by means of a release (63) actuated, upon the closing of the door, by the frame or the like, the release (63) and/or the force accumulator (55) being arranged behind the freely extending cuff rail sections (1'). In order to make the release possible also by a movement perpendicular to the cuff rail plane in the direction towards the strike plate (88), the release (63) is actuatable in a direction perpendicular to the front side of the cuff rail.

13 Claims, 15 Drawing Sheets

67
72
88
62
89
61
69
65
63
70
64
66
73
48
1'
68
45
59
58
55
57
56
60
71

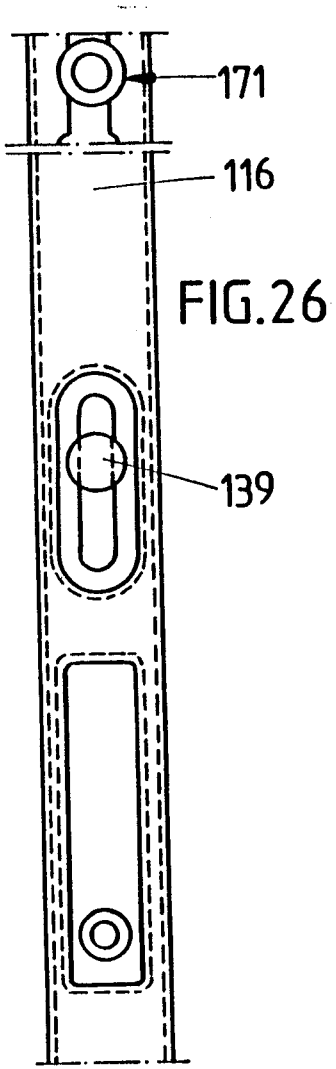
FIG.26
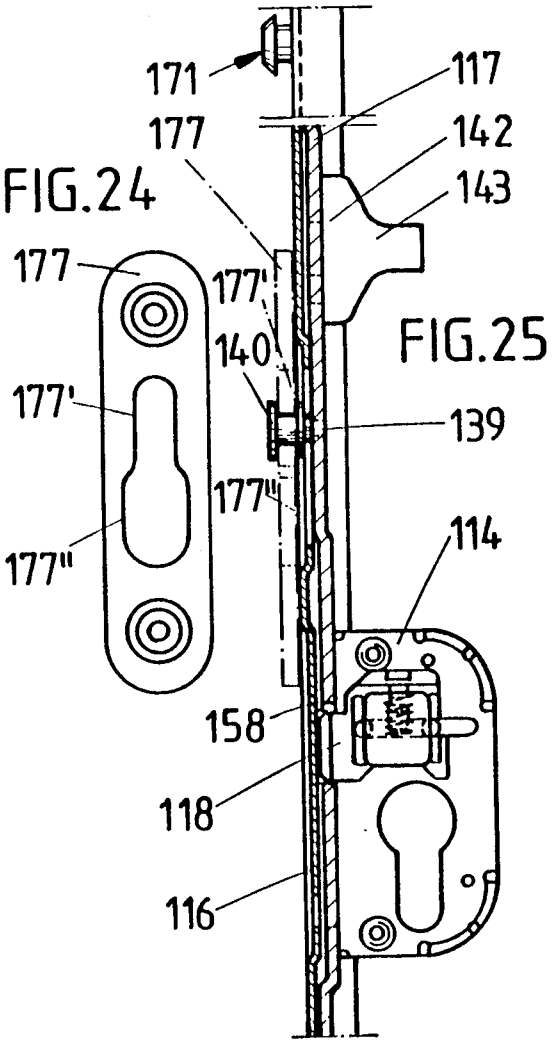
FIG.25
FIG.24
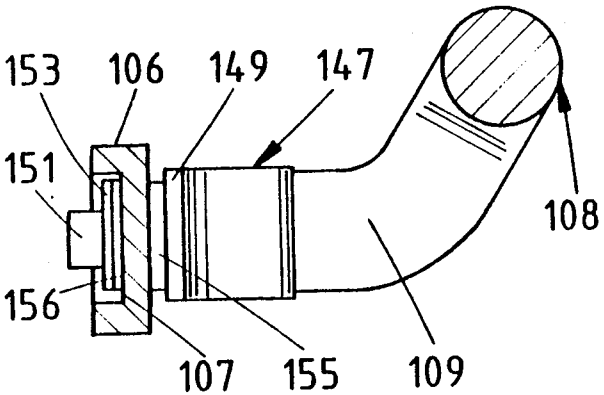
FIG.23
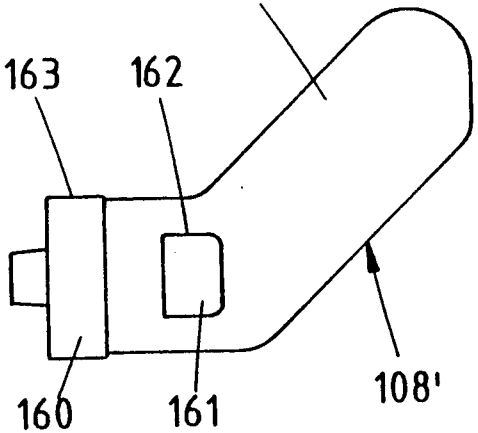
FIG.28

DRIVE-ROD LOCK

FIELD AND BACKGROUND OF THE INVENTION

The present invention relates to a drive-rod lock.

In a drive-rod lock of the type in question, the release and the force accumulator are arranged outside the lock housing in each case at the rear of the freely protruding cuff-rail sections so that the drive-rod lock can be made very small. It can be installed both with and without a force accumulator. Without force accumulator and release, the locking of the door must be effected in the customary manner. With the force accumulator and release, the locking members move into their locking position already upon the closing of the door. The loading of the force accumulator takes place upon the opening motion by actuation of the door handle. The possibility to use this embodiment, however, proves to be limited since the release can be actuated only in the direction transverse to the cuff-rail. In contrast to a hinged door, where the cuff-rail is swung in upon closing transverse to the strike plate, the cuff-rail is moved, for instance, in the case of a sliding door, perpendicular or approximately perpendicular against the strike plate.

SUMMARY OF THE INVENTION

It is the object of the present invention so to develop a drive-rod lock of the type in question in a manner simple to manufacture that the release is possible also by a perpendicular movement with respect to the cuff-rail plane in the direction towards the strike plate.

The drive-rod lock can be used both for sliding doors and for hinged doors. The release is preferably arranged on the free cuff-rail section and is of extremely slight depth of installation. The development of the drive-rod as spreading spring and the formation of the blocking edge by the cuff-rail make it possible to produce the release at a very small expense. In addition to two bends in the drive-rod, there are initially required only two spacers and a pin provided with an annular groove. Release and force accumulator can be located outside the lock housing so that the drive-rod lock can have small dimensions resulting in a slight lock installation depth which is advantageous, for instance, upon installation in tubular frame doors. Both the force accumulator and the release can be provided at any desired place of the freely protruding cuff-rail sections. When using the drive-rod lock on a sliding door, the release can be provided with an extremely flat head. The release then does not form any disturbing projection in the closed position and the position of the release need not be taken into account in the development of the strike plate. A favorable arrangement is therefore assured also with respect to the force accumulator. The cuff-rail sections and/or the drive-rods can form bends, with the formation of a chamber for receiving the force accumulator developed as compression spring. If required, several such chambers can be provided so that a predetermined force-accumulator force can always be realized. This development also serves the purpose of use of coupling the drive-rods via corner deflections and of providing locking members on the horizontal drive-rod sections. There is always sufficient force to bring the corresponding locking members into their locking position. If this is not the case, for instance in the event of a warped door, then the locking force can be further increased by the displacement of the door handle in the direction opposite that of normal door handle actuation.

The closing of the door causes a force to act on the release against the spring force of the U-shaped spreading spring so that the release passes out of its blocking position and releases the force accumulator while carrying along the drive-rods which, in their turn, bring the locking members into the blocking position. When using the drive-rod lock on a sliding door, the release is acted on perpendicularly by the strike plate. On a hinged door the release head is preferably developed as a truncated cone in the manner of a latch. When the door is swung into the frame, the release is then acted on either by the strike plate edge itself or by a run-on bevel of the strike plate. Upon the return movement of the drive-rods due to the displacement of the door handle, the release can always return into the blocking position due to the spreading spring which acts on it. In this blocking position the pin which is provided with the annular groove rests against a blocking edge which is formed by two recesses in the cuff-rail which are of different width and pass into each other. In addition to a detent force there must also be overcome the restoring force of the spreading spring in order to cause the force accumulator to act. It is favorable from an operating standpoint to develop the drive-rod which acts as a spreading spring as a U-shape and to guide it on the cuff-rail by two spacers. In order to obtain a favorable spring action, the distance of the spacers on the cuff-rail amounts to about 50 times the stroke of the release.

In addition to this, advantages result with respect to the development of the drive-rod lock itself. The structural parts which hold the nut in its basic central position can be arranged in a spatially favorable manner. They, together with the nut, can be assembled as an external installation unit in order then to install them in the lock housing, which results in low installation costs for the drive-rod lock. This installation unit furthermore makes it possible to manufacture drive-rod locks with small or widened mandrel dimension. The compression spring holds the actuating arm, the slide and the auxiliary slide together as one structural unit by means of the coupling pin in the manner that the claw-shaped end of the actuating arm is clamped between the end surface of the slide and the coupling pin. If a swinging motion of the actuating arm takes place in the one direction, then the auxiliary slide is carried along by the coupling pin against the force of the compression spring. Displacement of the actuating arm in the other direction, on the other hand, leads to a direct action on the slide by the claw-shaped end, together with a compression of the compression spring from the other side. This means that the actuating arm is acted on either by a pulling or pushing action. The claw-like engagement below the coupling pin also leads to advantages from an assembly standpoint. The combining of auxiliary slide, slide and actuating arm with the compression spring to form a structural unit is favored by the mandrel which extends from the auxiliary slide, which, in space saving manner, extends through both the compression spring and the slide and surrounds the pin with its yoke-shaped end. Due to the fact that the slide receives a part of the length of the compression spring, the latter is stabilized against kinking. It also is in this case arranged in protected manner within the corresponding structural member. In order that the coupling pin is not carried along upon the one displacement of the actuating arm, it strikes against the one end of the arcuate slot in the lock housing. The claw-shaped end then presses against the slide and displaces the latter against the force of the compression spring. When the swinging motion of the actuating arm takes place in the other direction, displacement of the slide is blocked by the mating stop edge which is opposite the stop edge of the slot. If the actuating arm is developed with two arms, then the one arm forms the claw shaped end and the other arm forms the lever to which the link plate coupled to the nut is attached. It is evident from the above that the prefabricated installation unit can be substantially adapted to structural circumstances in the manner that this installation unit can be arranged in the lock housing at any angle. Furthermore, the adjustability of the length of the mandrel has installation advantages. Simultaneously with adjustment of the mandrel length, the pre-tensioning of the compression spring has also changed. The adjustment of the mandrel length can take place, for instance, by thread adjustment. The end of the mandrel attached to the auxiliary slide is then provided with an external thread and the auxiliary slide with an internal thread. After the assembling of the coupling pin, actuating arm and slide and the placing on of the compression spring, the auxiliary slide need merely be screwed on, it permitting in simple manner the adjusting of the compression spring to the corresponding tension.

BRIEF DESCRIPTION OF THE DRAWINGS

With the above and other objects and advantages in view, the present invention will become more clearly understood in connection with the detailed description of preferred embodiments, when considered with the accompanying drawings, of which

FIG. 23 is a cross-section through the escutcheon, the section line extending above the slide, FIG. 24 is a plan view of a strike plate on the frame side, FIG. 25 shows, partially in outer view and partially in longitudinal section, the drive-rod lock in the region of the locking mechanism corresponding to the locked position of the drive-rod, FIG. 26 is an outer view of the cuff-rail in the region of a locking pin, FIG. 28 is a top view of the grip associated with the escutcheon on the inner side.

DETAILED DESCRIPTION OF THE PREFERRED EMBODIMENTS

Figure 1:
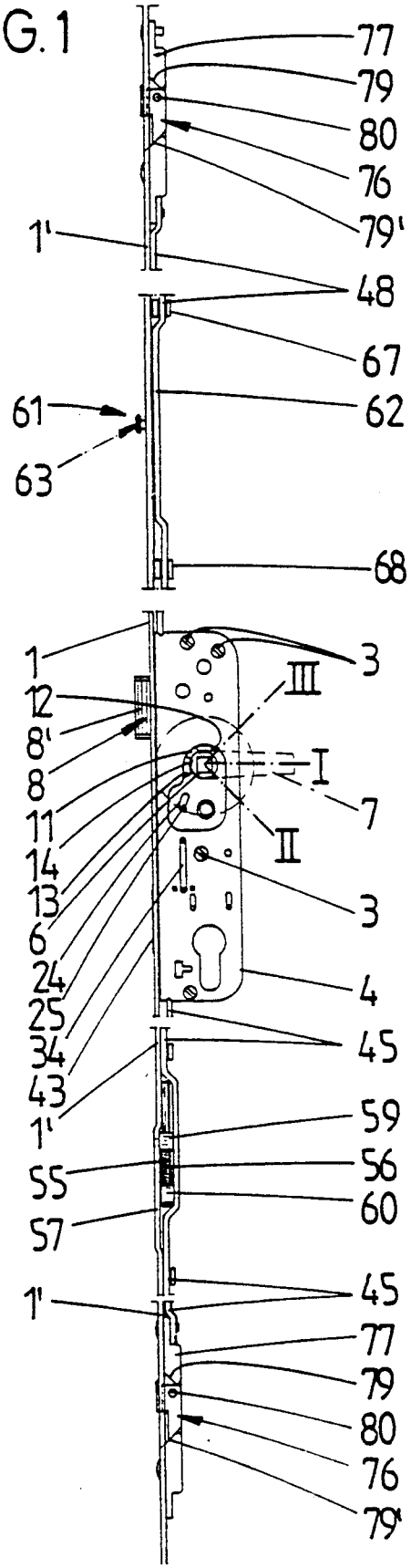
FIG. 1 is a view of the drive-rod lock with the door opened, the force accumulator loaded and the locking members introduced into the cuff-rail sections.
Figure 2:
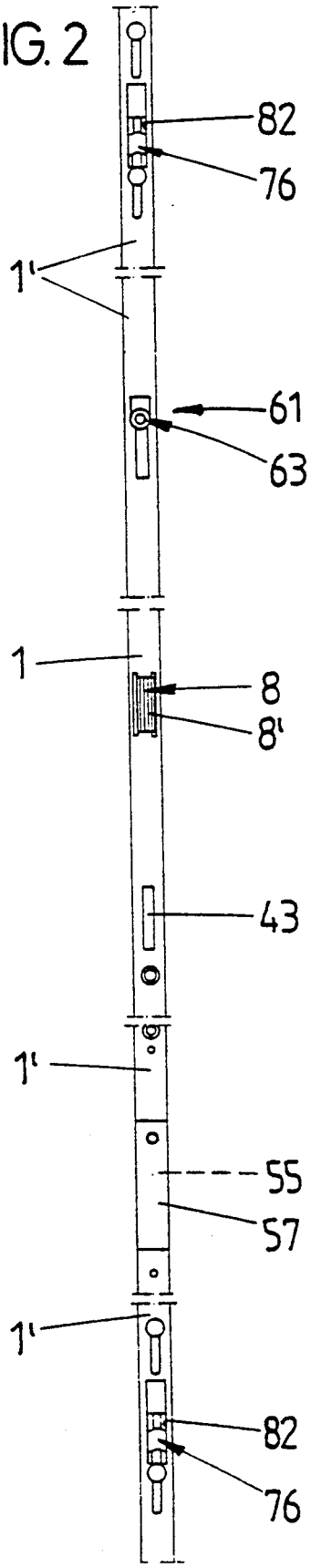
FIG. 2 is a rotated view of FIG. 1.

The drive-rod lock has a cuff-rail 1 to which a lock bottom 2 is attached at a right angle. Parallel to said lock bottom there is a lock cover 4 attached by screws 3 which engage in stud bolts 5 on the lock bottom side. The said cuff-rail 1 extends beyond the lock housing into freely protruding cuff-rail sections 1'.

In the upper region of the lock housing, a nut 6 is mounted in the lock bottom 2 and the lock cover 4 to receive a door handle 7, indicated in dash-dot line in FIG. 1. When the door handle assumes its horizontal position I, this corresponds to the basic central position. The position indicated by the line II is the position in which the nut 6 retracts a latch 8. The latter consists of a latch head 8' and a latch tail 8''. The latch head 8, is guided in the cuff-rail 1 while the latch tail 8'' is guided in the lock bottom side. A leg spring 9 acts on the latch tail 8'' and urges the latch 8 in outward direction. The latch tail 8'' is acted on by a nut arm 10 of the nut 6. The nut 6 is furthermore provided with a rotation limiting stop 11 which extends from the nut arm 10 and cooperates with the stop edges 12, 13 of an arcuate opening 14 in the lock cover 4 so that the door handle positions II and III are thereby imparted a stop limitation. The door handle positions II and III form an angle of about 90° between themselves so that the door handle can swing 45° in both directions out of its horizontal position I.

A further arm 15 extends from the nut 6 at a right angle to the latch actuation nut arm 10. A link plate 17 engages there by means of a pivot pin 16, the link plate being coupled, in its turn, via a pivot shaft 18 to the second arm 19 of an actuating arm 20. The latter is mounted below the nut 6 around a linking pin 21 on the lock-housing side. The first arm 22 opposite the second arm 19 forms a claw-shaped end 23 which engages under a coupling pin 25 guided in an arcuate slot 24 in lock bottom 2 and lock cover 4. At the height of the claw-shaped end 23, the coupling pin 25 is surrounded by a yoke 26 which extends into a downward directed mandrel 27 which extends approximately parallel to the cuff-rail 1. At its end, the mandrel 27 has a threaded section 28. The latter engages into an internal thread of a pin-shaped centering projection 29 of an auxiliary slide 30. A guide projection 31 extending from said auxiliary slide extends into an approximately vertically extending longitudinal slot 32 in the lock bottom 2. Opposite the guide projection 31, a groove 33 is provided on the auxiliary slide 30, an inwarddepressed rib 34 of the lock cover 4 extending into said groove 33. This rib 34 extends parallel to the direction of the longitudinal slot 32, whereby the auxiliary slide 30 is imparted exact guidance.

The upper end of the longitudinal slot 32 forms a counter stop edge 35, opposite which, at a certain distance away, there is the stop edge 36 of the arcuate slot 24. The coupling pin 25 is pulled against this stop edge 36 by a compression spring 37 which urges the auxiliary slide 30 in a downward direction and surrounds the centering projection 29 and thus also receives the mandrel 27.

The mandrel 27 extends through a slide 38. This slide forms, at its upper end, a projection 39 which extends into the longitudinal slot 32. The lower end of the slide 38 facing the lock cover 4 is also provided with a groove 40 into which the rib 34 extends. The slide 38 receives only a part of the length of the compression spring 37 and, at the level of the projection 39, has a supporting surface 41 for the facing end of the compression spring 37. As a result of the above-described development, the claw-shaped end 23 of the actuating arm 20 is clamped between the upper end surface 42 of the slide 38 and the coupling pin 25 so that actuating arm 20, mandrel 27, auxiliary slide 30, compression spring 37 and slide 38 form a coherent structural unit which can be inserted as a whole into the lock. This structural unit may also include the articulated plate 17 and the nut 6 so that a coherent, easily assembled chain is obtained. This development makes it possible to arrange the coherent structural unit in different alignments within the lock housing of a drive-rod lock. The guide slots merely have to be provided in the corresponding position.

Another component of the drive-rod lock consists of a bolt 43 arranged below the above-described structural unit, a bolt keeper 44 which is spring-loaded in downward direction being associated with said bolt 43. The bolt 43 extends through a lower drive-rod 45 of the drive-rod lock. This drive-rod 45 extends on the inside of the cuff-rail 1 and the lower cuff-rail section 1' and is provided at the height of the actuating arm 20 with a tooth-strip section 46. Adjacent this section, the drive-rod 45 is in form-locked engagement with a drive-rod connecting piece 47 which can be displaced parallel to the cuff-rail 1 and from which an upper drive-rod 48 extends.

The displacement of the drive-rods 45, 48 is effected by a double-armed tooth segment 51 which is also mounted for rotation on the linking pin 21. The one arm forms a toothing 52 which is in engagement with the tooth-strip section 46. Both arms of the toothed segment 51 are provided with diametrically opposite arcuate slots 53, 54. The pivot shaft 18 between link plate 17 and the second arm 19 extends into the arcuate slot 53. In the open position of the drive-rod lock, i.e. when the door is open, the pivot shaft 18 is at the upper end of the arcuate slot 53. The other arcuate slot 54, on the other hand, is passed through by the coupling pin 25 which, in this position, is at the lower end of the arcuate slot 54. An idle stroke is therefore created between actuating arm 20 and toothed segment 51.

On the rear side of the lower cuff-rail section 1' there is provided a force accumulator 55, developed as a compression spring. The force accumulator extends in a receiving chamber 56 which is formed by oppositely directed bends 57 and 58 of the lower cuff-rail section 1' and of the lower drive-rod 45. The force-accumulator compression spring 55 is supported on the one end by a projection 59 riveted to the cuff-rail section 1'. At the other end, opposite the projection 59, an abutment 60 is attached to the drive-rod 45. When the drive-rod 45 moves in an upward direction, the force accumulator 55 is loaded via the abutment 60.

A detent device 61 arranged above the lock housing in the upper cuff-rail section 1' serves to secure the loaded position of the force accumulator 55. The detent device has a release 63 which is formed with a blocking edge 71. The release consists of a pin 65 which is firmly attached to the spreading spring 62 and has an annular groove 66 and a wide head 64. The blocking edge 71 is formed by the two recesses 69 and 70 in the cuff-edge 1'. The pin 65 is so developed that its diameter is smaller than the width of the recess 69 and larger than the slot 70 and that the diameter of the annular groove is smaller than the width of the slot 70. As is shown, in particular, in FIG. 5, the drive-rod 48 is developed as spreading spring 62, it being slidingly mounted in relaxed condition by two spacers 67, 68 on the cuff-rail and having an upper bend 72 and a lower bend 73. In the blocking position of the release 63, when the force accumulator 55 is loaded and the spreading spring 62 relaxed, the pin 65 is in the recess 69 and is held in this position by the blocking edge 71 and thus prevents the force accumulator from unloading. A movement of the drive-rods 45, 48 in a downward direction is, therefore, not possible. The lock ward thus remains in the position as shown in FIG. 3 when the door is open.

On the other side of the release 63 and the force accumulator 55, additional locking members 76 are provided in the region of the cuff-rail sections 1'. They are developed as swivel bolts in the embodiment shown. When the drive-rod lock is used on a sliding door these locking members engage in the manner of a sickle behind the strike plate through special engagement openings. The control of the swivel bolts 76 is effected by both the upper drive-rod 48 and the lower drive-rod 45. For the sake of simplicity, only the control of the lower swivel bolt 76 by the lower drive-rod 45 will be explained. The lower drive-rod 45 has a driver 77 which has a central recess 78. The latter is elongated in the manner that the narrow edges 79, 79' diverge towards the cuff-rail section 1'. In the upper region of the recess 78, a bearing pin 80 is provided for the single-arm swivel bolt 76. In the loading position of the force accumulator 55, the swivel bolt 76 is retracted. Its roof shaped engagement end 81 then extends in an outlet opening 82 of the cuff-rail section 1'. The transverse edges 83 and 84 of the outlet opening 82 form control surfaces for the swivel bolt 76 which has corresponding mating control surfaces 85, 86. In the open position of the swivel bolt 76, the mating control surface 86 rests against the narrow edge 79'.

Figure 3:
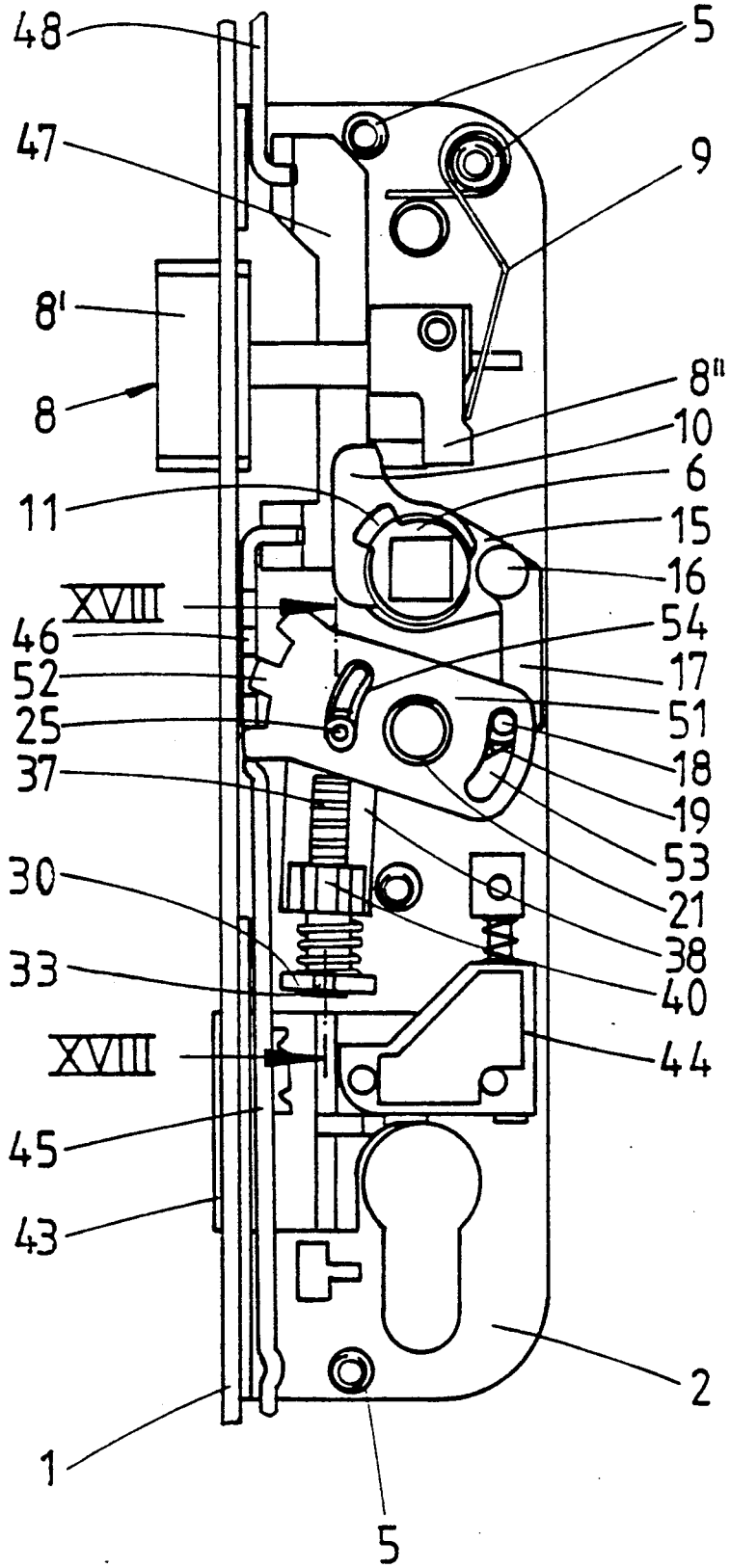
FIG. 3 is a detailed view of the drive-rod lock with the lock cover removed, looking at the lock ward in the position corresponding to the door open.
Figure 4:
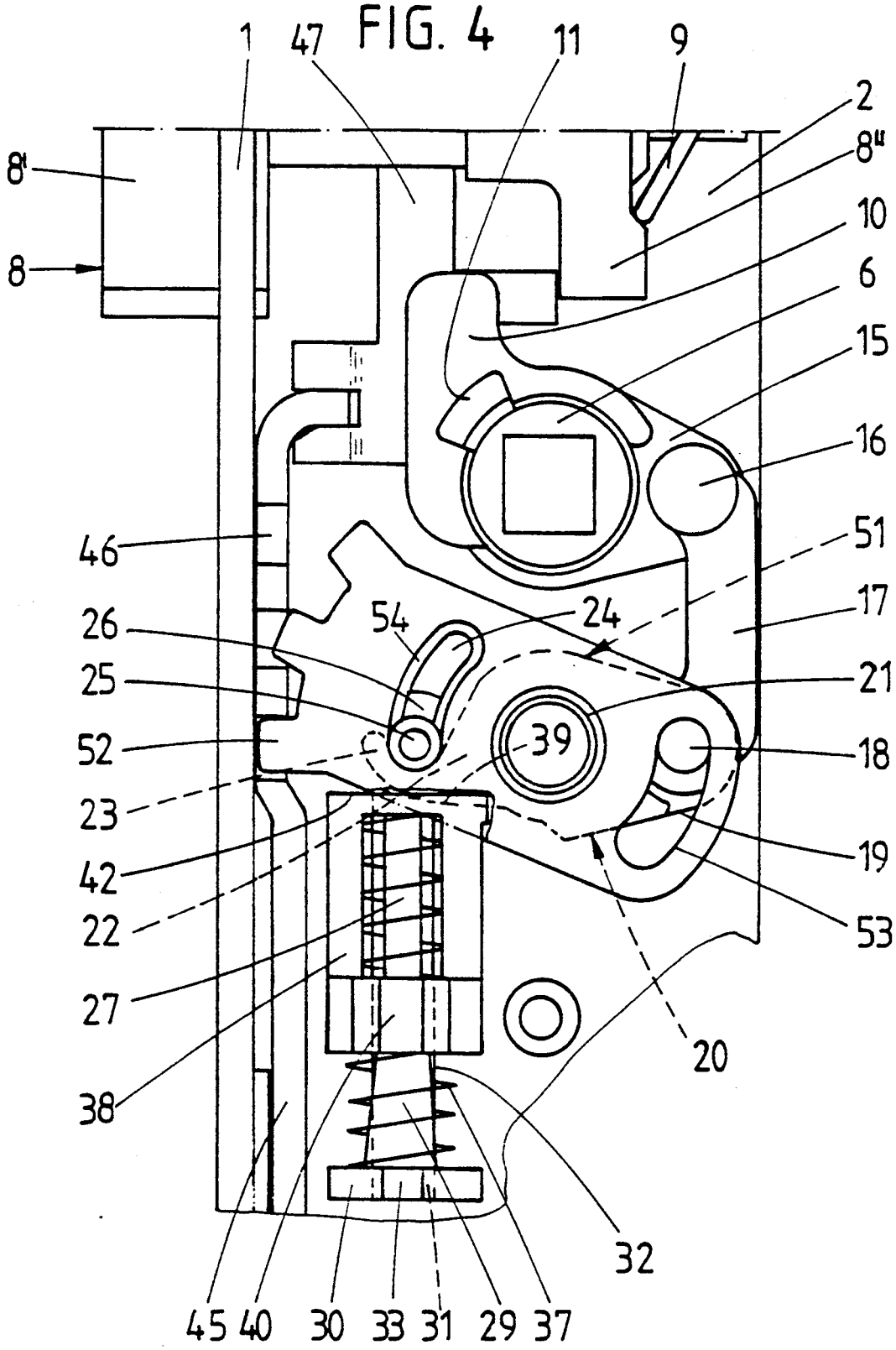
FIG. 4 shows in large detail the structural unit which holds the nut in its basic central position corresponding to the open position.
Figures 5, 6, 7:
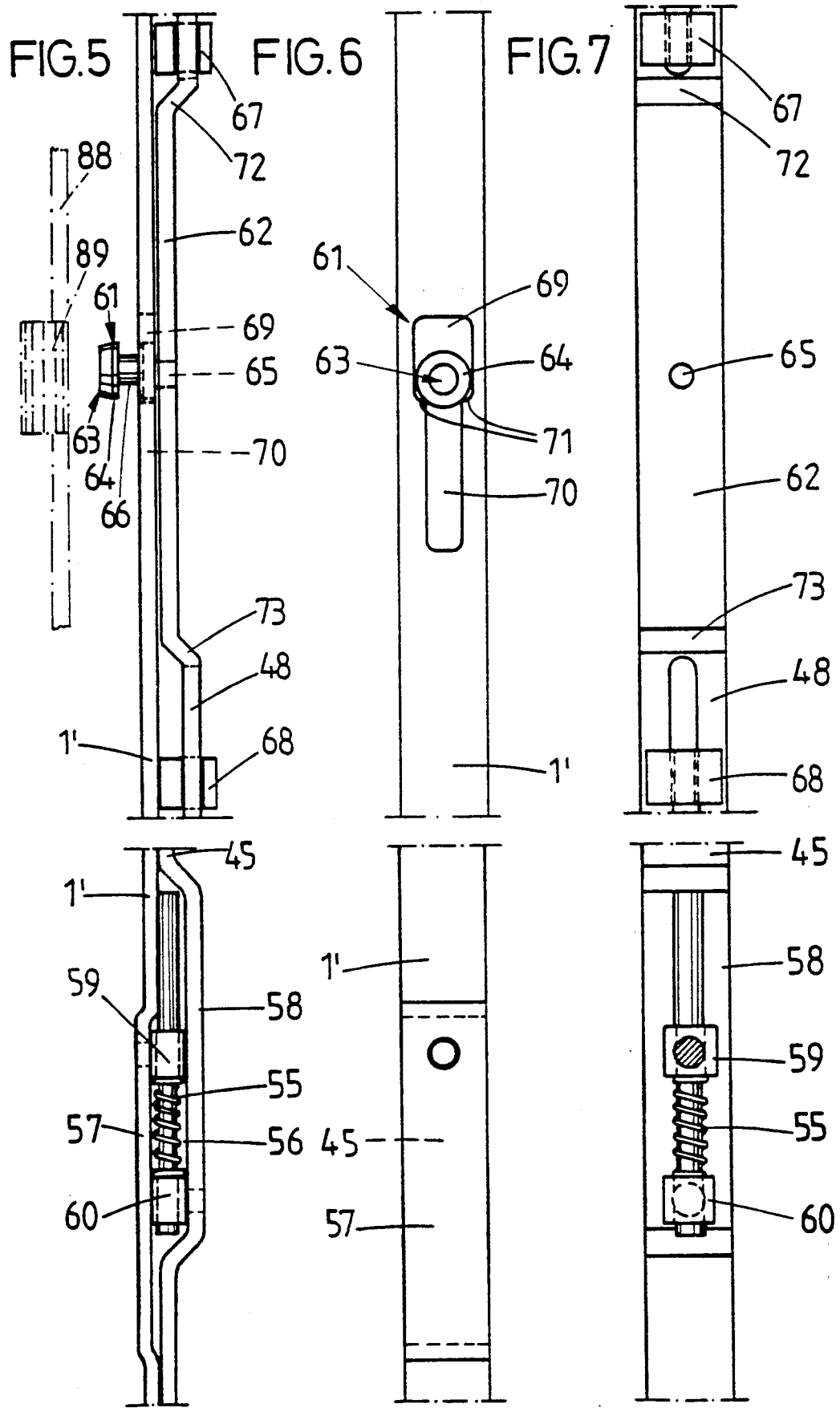
FIG. 5 is a side view of the cuff-rail sections in the region of the release and of the force accumulator corresponding to the door open, i.e., with the force accumulator loaded and secured, the strike plate being indicated.
FIG. 6 is a rotated view thereof.
FIG. 7 is a view of the release device and the force accumulator, the cuff-rail sections being omitted.
Figure 8:
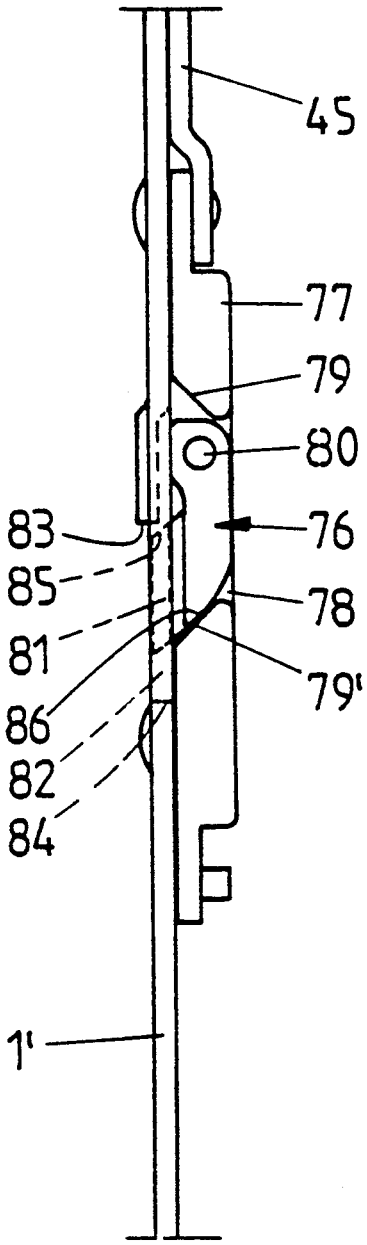
FIG. 8 is a view of the lower cuff-rail sections in the region of the locking member which is developed as swivel bolt, in the release position of the locking member.
Figure 9:
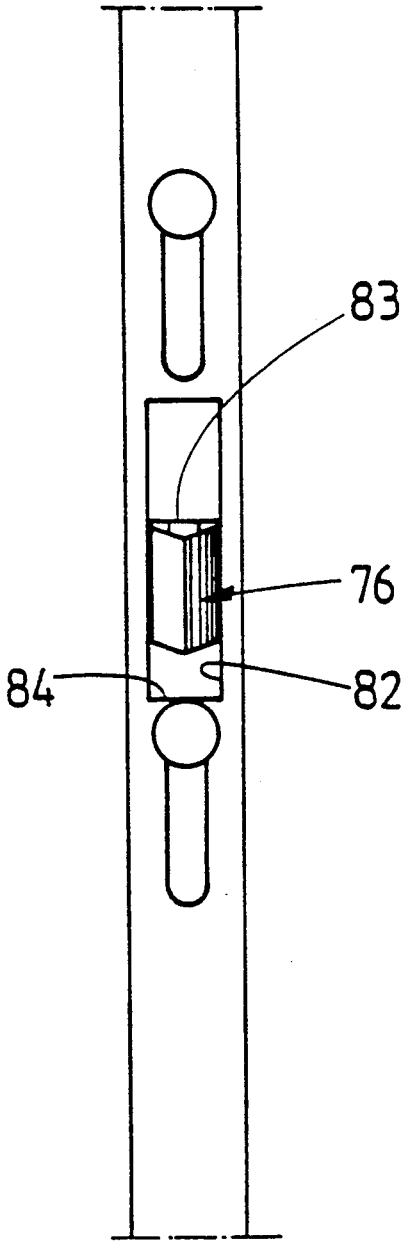
FIG. 9 is a rotated view thereof.

The drive-rod lock operates as follows:

If a door equipped with the drive-rod lock of the invention is in its open position, then the drive-rod lock is in the position shown in FIGS. 3, 5 and 8. The force accumulator 55 is cocked but prevented from unloading by the detent device 61. The drive-rods 45, 48 cannot move and push out the swivel bolts 76.

Figure 10:
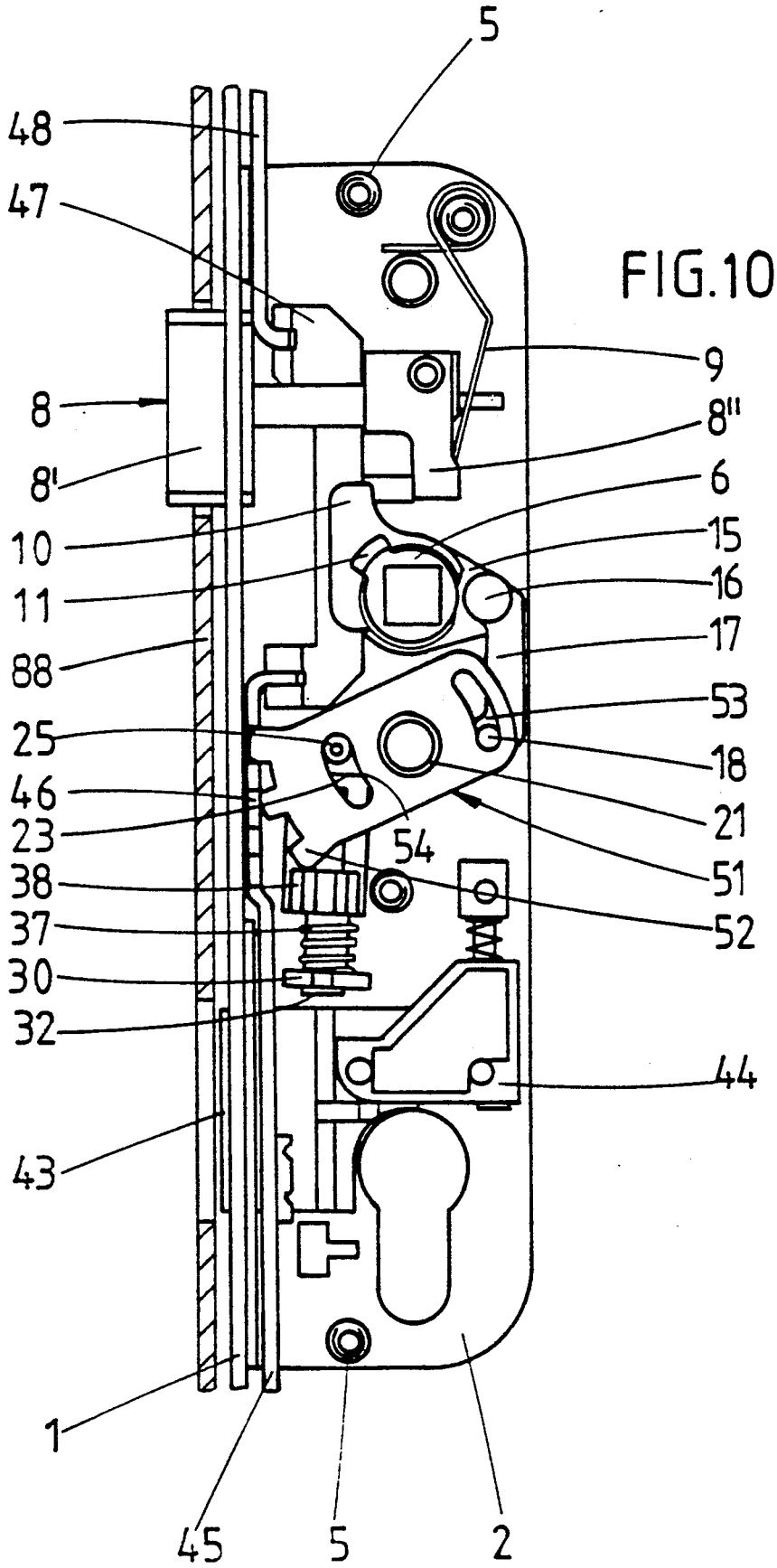
FIG. 10 is a view corresponding to FIG. 3 in which the door has been brought into the closed position, with the drive-rods displaced.
Figure 11:
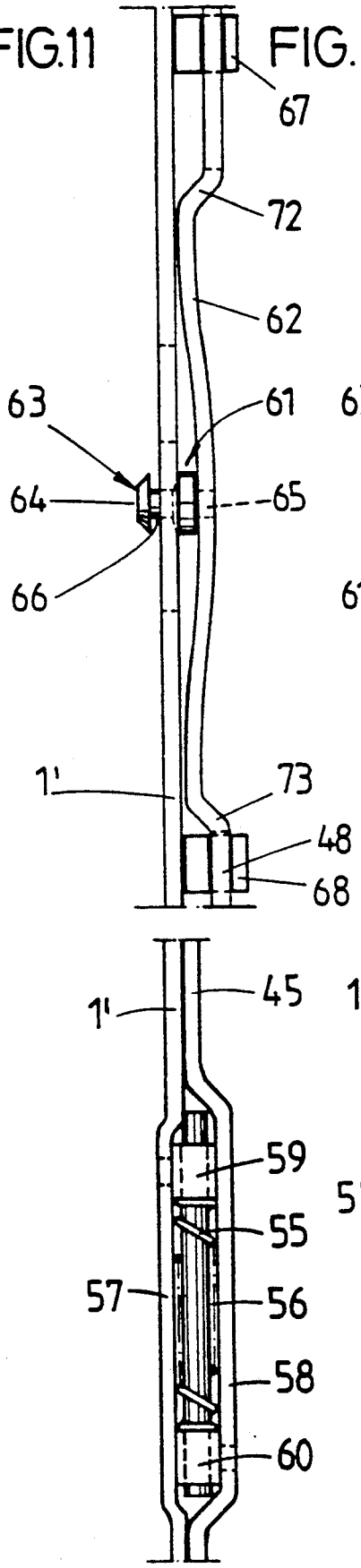
FIG. 11 is a view corresponding to FIG. 5 but with the force accumulator unloaded.
Figure 12:
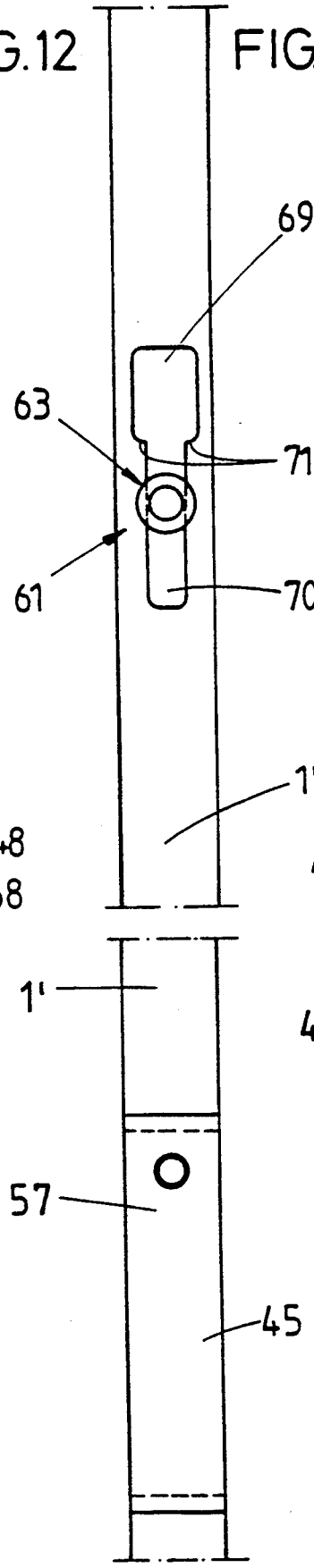
FIG. 12 is a view corresponding to FIG. 6 but with the release displaced.
Figure 13:
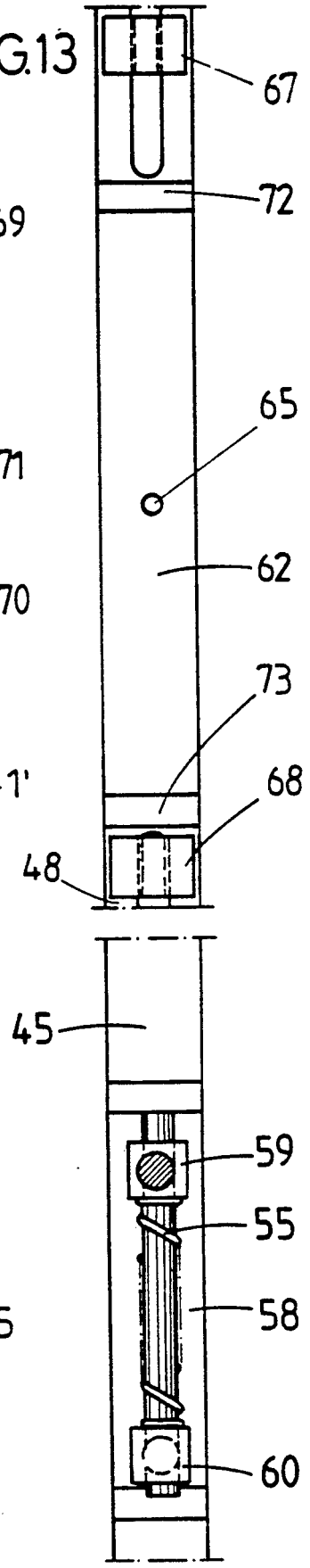
FIG. 13 is a view corresponding to FIG. 7 but with the release displaced.
Figure 14:
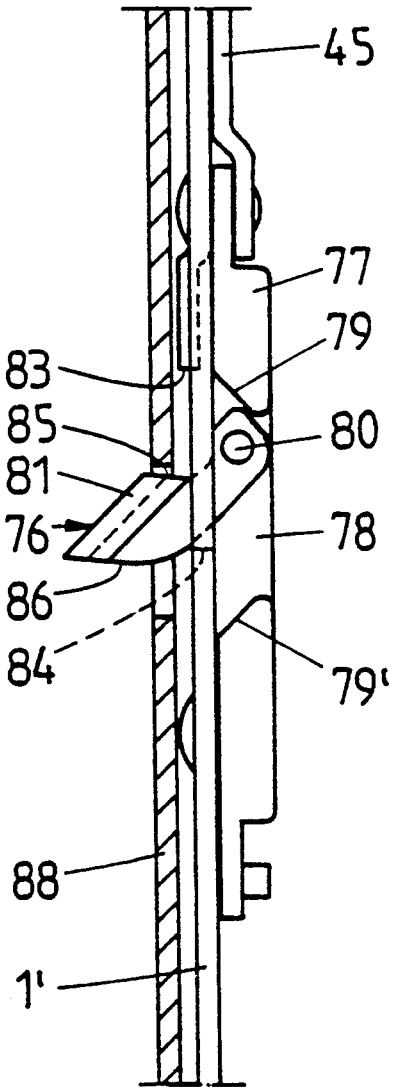
FIG. 14 shows the locking member in its locking position.
Figure 15:
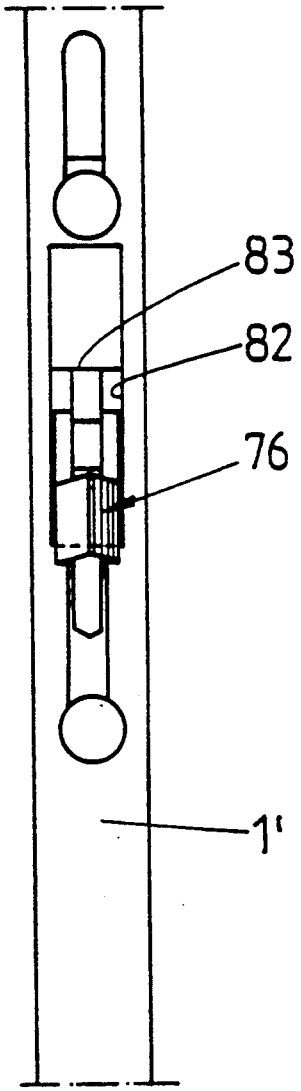
FIG. 15 shows the corresponding side view.

When the door is closed or pushed shut, the release 63 is acted on by the strike plate 88 on the door-frame side or by the run-on bevel 89 and displaced against a certain detent force and the restoring force of the spreading spring 62. In this case, the pin 65 loses its support on the blocking edge 71 so that the force accumulator 55 can enter into action and unload together with a downward displacement of the drive-rods 45, 48, the annular groove 66 of the pin 65 engaging into the slot 70. The drive-rod lock then assumes the position shown in FIG. 10 while the detent device 61 and force accumulator 55 enter into the position shown in FIG. 11. Simultaneously with the downward displacement of the drive-rods 45, 48, the drivers 77 also displace the swivelbolts 76. The mating control surface 86 strikes against the transverse edge 84 of the outlet opening 82 and thereby forces an outward displacement of the swivel member 76. After closing the door, assurance is thus had that both the latch 8 and the locking members (swivel bolts) 76 are un engagement with the strike plate 88 on the door-frame side or have entered into the locking engagement openings present there. Warping of the door is thus counteracted. It is then possible in this position to advance the bolt 43 by means of a lock cylinder.

Figure 17:
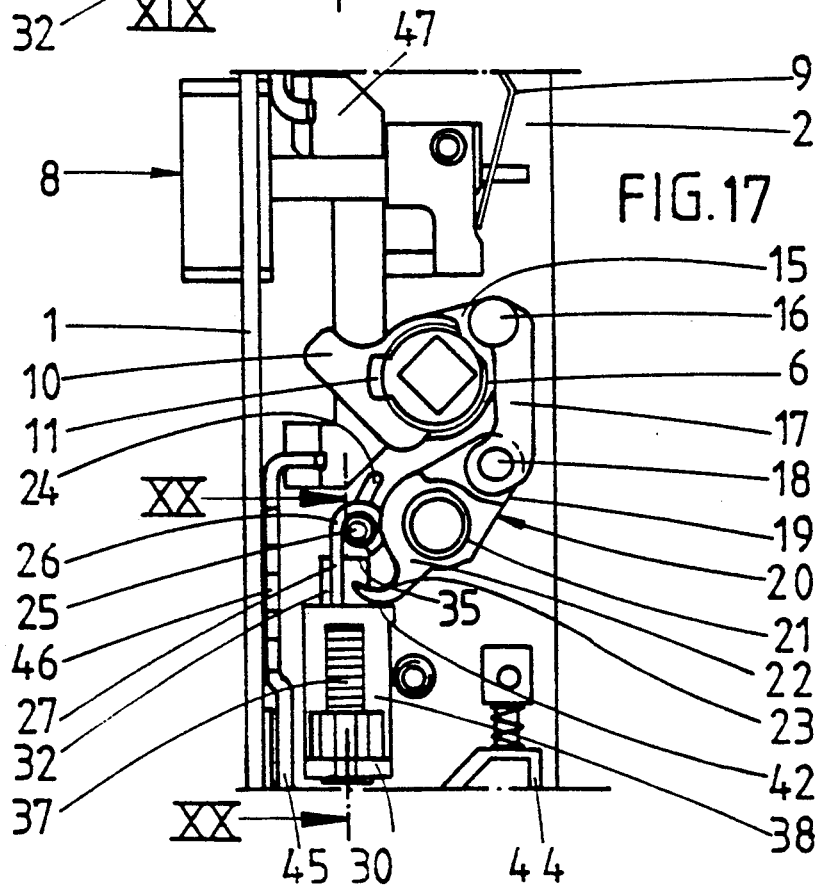
FIG. 17 shows a section of the drive-rod lock in the region of the nut which is swung in counter-clockwise direction with simultaneous displacement of the drive-rods and of the locking members controlled by them into the locking position.
Figure 18:
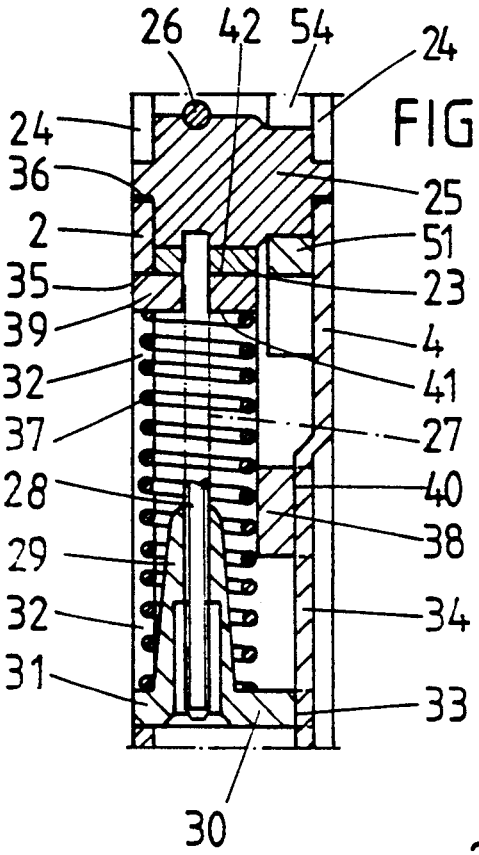
FIG. 18 is a section along the line XVIII—XVIII of FIG. 3.
Figure 20:
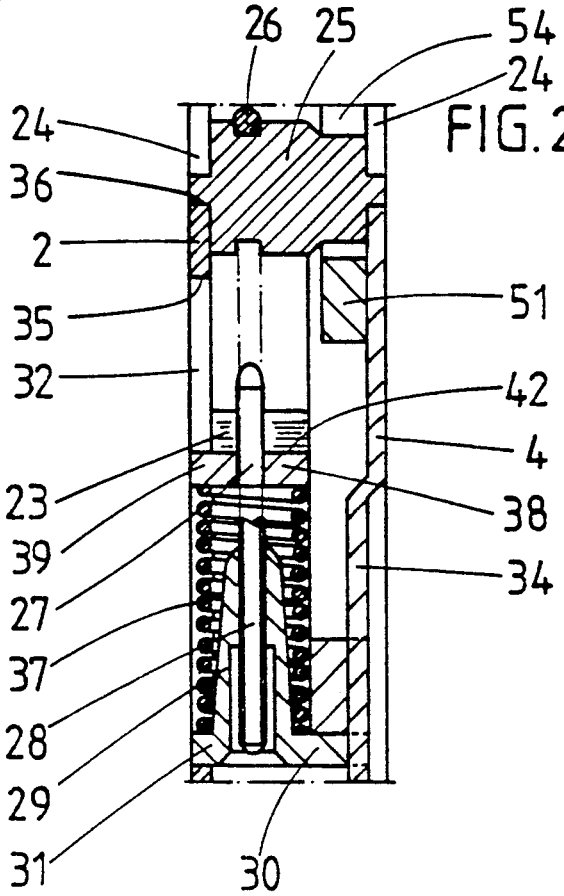
FIG. 20 is a section along the line XX—XX of FIG. 17.
Figure 21:
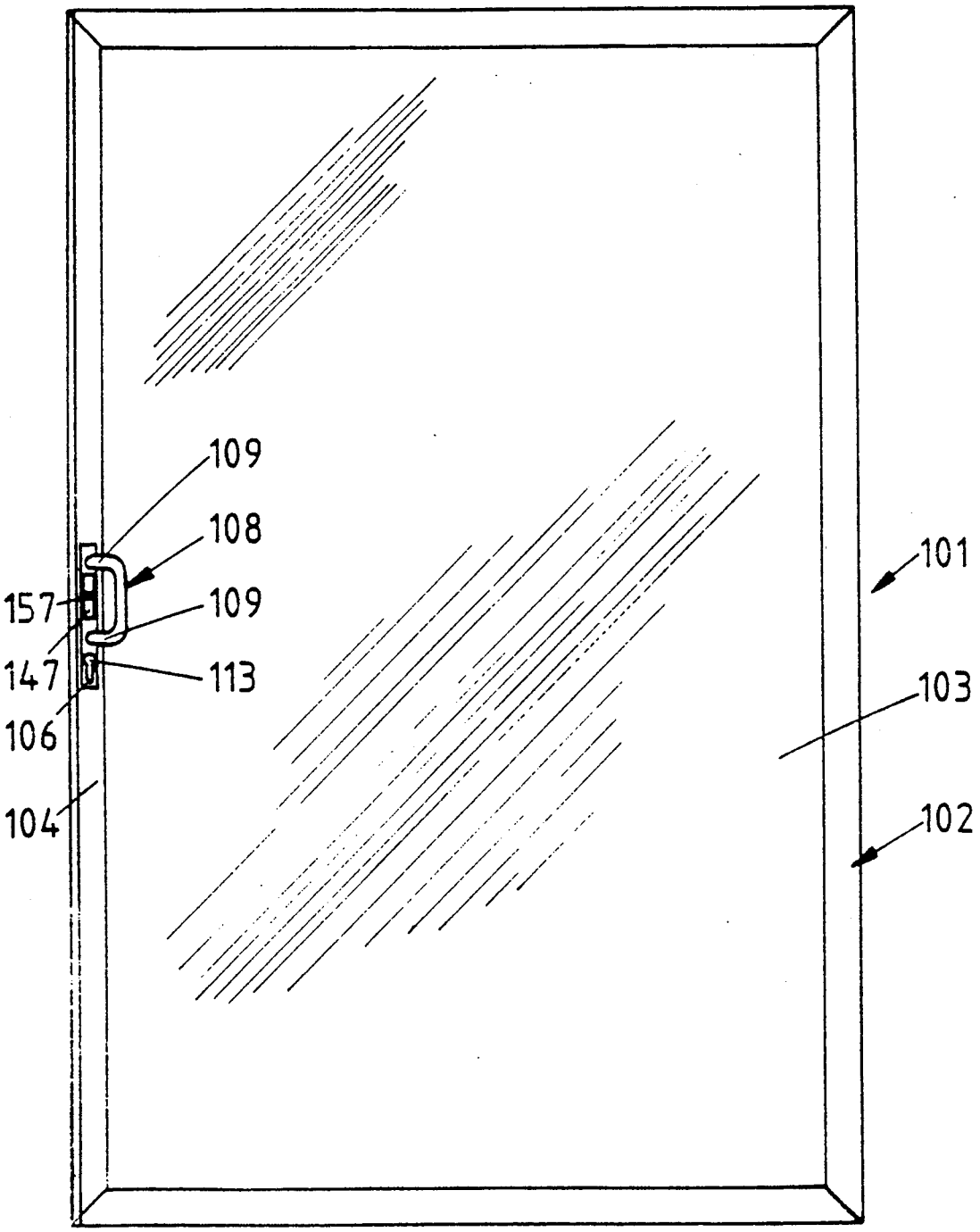
FIG. 21 is an outer view of a sliding door provided with a drive-rod lock.
Figure 22:
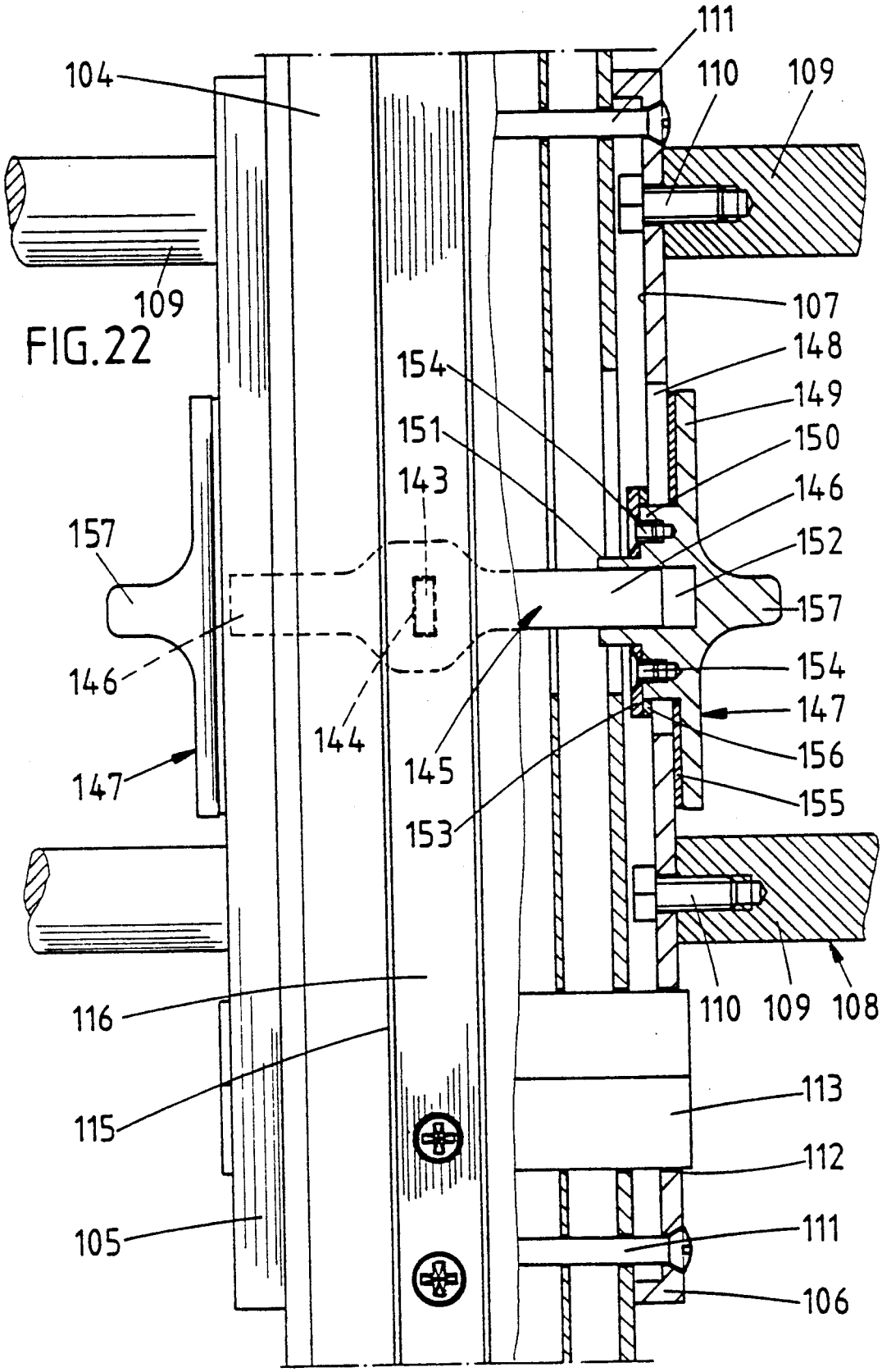
FIG. 22 shows the drive-rod lock associated with the sliding door, shown partially as outer view and partially in a longitudinal section.

If it was not possible upon the closing of the door for one or both locking members 76 to enter into their engagement openings, then the displacement of the drive-rods 45, 48 is also blocked thereby. In that case, however, there is the possibility of supporting the force accumulator in the manner that the door handle 7 is displaced in counterclockwise direction into position III while positively carrying along the drive-rods, together with an extending of the swivel bolts which enter with their roof-shaped engagement end into the corresponding engagement opening of the strike plate 88. During this swinging motion, the nut 6 and the parts coupled with it pass into the position shown in FIG. 17. Via the link plate 17 and the actuating arm 20, the tooth segment 51 is immediately carried along, it moving the drive-rod 45 and, via the drive-rod connecting piece, the other drive-rod 48 downward. This swinging motion is limited by the stop edge 13 of the lock cover 4 against which the rotation-limiting stop 11 of the nut 6 strikes. By the swinging of the actuating arm 20, its claw-shaped end 23 acts on the end surface 42 of the slide 38 which moves downward against the force of the compression spring 37, see also FIG. 20. The coupling pin 25 against which the mandrel 27 and thus the auxiliary slide 30 rest remain in their position. If the door handle 7 is then released, the slide 38 returns under a spring action into its starting position, with simultaneous swinging of the actuating arm 20 which, via the link plate 17, returns the nut 6 and thus the door handle 7 into the basic central position. As a result of the arcuate slots 53, 54, the toothed segment 51 remains in place so that the pivot shaft and the coupling pin 25 are adjacent the opposite ends of the arcuate slots 53, 54.

Figure 16:
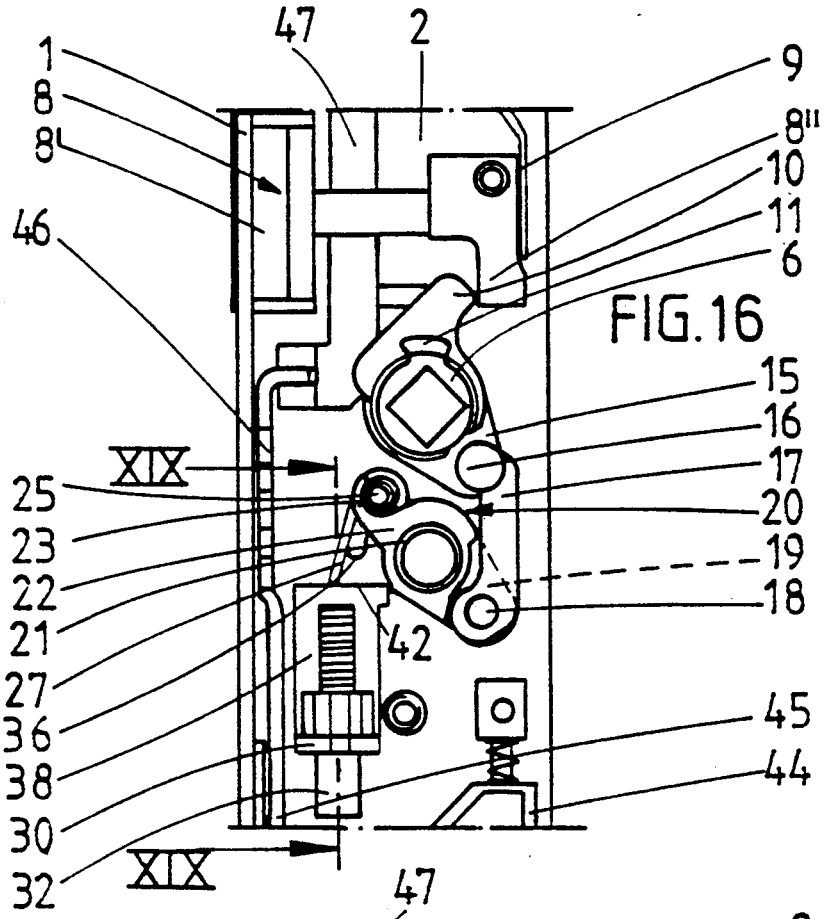
FIG. 16 shows the drive-rod lock in the region of the nutside during the retraction of the latch and the loading of the force accumulator, with simultaneous upward displacement of the auxiliary slide.
Figure 19:
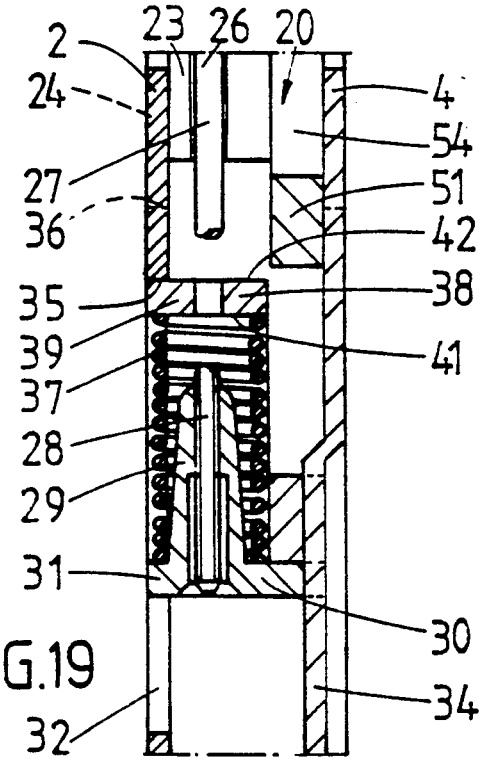
FIG. 19 is a section along the line XIX—XIX of FIG. 16.

If the bolt 43 has been advanced, the opening of the door requires that it be retracted. The door handle 7 must then be moved into position II, the lock ward passing into the position shown in FIGS. 16 and 19. By means of the nut 6, the latch 8 is retracted. Furthermore, the link plate 17 swings the actuating arm 20 whereby the auxiliary slide 30 moves via the mandrel 27 against the force of the compression spring 37 in upward direction. The slide 38 is supported in its turn on the mating stop edge 35 of the longitudinal slot 32; see also FIG. 19. The toothed segment 51 is also carried along during this process. It comes to rest in its end position. Under the action of the compression spring 37, the arcuate slots 53, 54 then permit the swinging back of the actuating arm 20 and the nut 6 into the starting position shown in FIG. 3. The swinging toothed segment 51 has displaced the drive-rods 45, 48. The force accumulator 55 is loaded thereby while the release 63 is raised by the upward movement of the drive-rod 48 above the blocking edge 71 and engages into its locking position due to the spring urging by the spreading spring 62. By the displacement of the drive-rods 45, 48 and by cooperation of transverse edge 83 and mating control surface 85, the locking members 76 have been swung into their release position. The next locking process can then take place.

From the position shown in FIG. 3, the nut can at any time be retracted by displacement of the door handle in clockwise direction. In the process, the slide 38 is displaced by the actuating arm 20 against the force of the compression spring 37. As a result of the idle stroke, the toothed segment 51 is not carried along. The compression spring 37 then brings the above-mentioned structural parts back into their normal position. Upon such a closing of the door, the latch 8 is not displaced by the strike plate on the frame side. The door can in this way be closed with little noise, the triggering and releasing of the force accumulator 55 again taking place in the final closing phase, together with an outward movement of the locking members 76.

The auxiliary slide 30, which can be screwed on the threaded section 28 of the mandrel 27, furthermore permits adjustment of the mandrel length and thus a corresponding adjustment of the initial tension of the compression spring 37.

FIGS. 21 to 30 show two further embodiments. In both embodiments the drive-rod lock is associated with a sliding door 101. The latter has a cross-sectionally profiled frame 102 which is filled by a pane of glass 103.

The left-hand vertically extending frame leg 104 bears on the outer side of the door an escutcheon 105 and in aligned opposite position on the inner side of the door an escutcheon 106. Both are almost identical in their structure. At the rear, each escutcheon is provided with a free space 107. Each escutcheon 105, 106 bears a U-shaped grip 108. The front ends of the U-arms 109 are at the level of the longitudinal center line of the escutcheons 105, 106. The handle 108 is attached by attachment screws 110 which are screwed in from the rear side of the escutcheon, pass through corresponding openings in the escutcheon and engage in threaded bore holes of the U-arms 109. The screw heads of the attachment screws 110 are then located in the free space 107.

The attachment of the handle 108 is such that the upper U-arm 109 is adjacent the upper transverse edge of the escutcheon 105, 106.

Both escutcheons 105, 106 are connected by means of coupling screws 111 which extend from the escutcheon on the inner side of the door and engage in threaded bore holes (not shown) of the outer escutcheon 105 in such a manner that an unauthorized opening from the outside by unscrewing the outer escutcheon cannot take place.

Below the lower U-arm 109 there extends an insert opening 112 in the escutcheon 105, 106 for installation of a lock cylinder 113. At the same time the lock cylinder 113 engages through a locking mechanism 114. The latter is supported by a cuff-rail 116 inserted in a frame groove 115 of the sliding door 101, a drive-rod 117 extending behind the cuff-rail. The drive-rod 117 engages through the locking mechanism 114 and is provided with a window (not shown) into which a bolt 118 (not shown in detail) of the locking mechanism 114 engages in the locking position of the drive-rod 117. The lock cylinder 113 serves to control the bolt 118 in such a manner that the bolt 118 can be displaced only after the raising of a bolt keeper.

A force accumulator, as described above, is provided at the rear of the lower cuff-rail section. The detent device, which has also been described above, serves to secure the loaded position of the force accumulator.

Above the locking mechanism 114, the drive-rod 117 bears a coupling plate 142 which has a central, stepped-down coupling projection 143. The latter is of rectangular cross-section and engages, fixed for rotation, into a cross-sectionally adopted opening 144 in an arm 145 which completely intersects the frame profile. The arm 145 is developed as a flat plate which is flat in the displacement plane of the drive-rod 117 in the manner that the flat plate has a larger area in the region of the opening 144 from which area stepped down sections 146 extend. These sections are acted on by slides 147 which are guided in both escutcheons 105, 106. The slides are guided parallel to the drive-rod displacement direction in the escutcheon and represent the handle for the displacement of the drive-rod 117.

Each slide 147 is guided in the region between the two arms 109 of the handle 108 which is shaped in the form of a U. A slot guide is used for this purpose. The corresponding slot 148 extends along the connecting line between the U-arm attachment points. From the rectangular base plate 149 of the slide 147, which base plate is arranged on the outer side of the escutcheon, there extends towards the inside of the escutcheon a stepped down region 150 the width of which is adapted to that of the slot 148. Its length, however, is less than that of the slot 148 so as to be able to displace the slide 147, or handle. The region 150, in its turn, continues into a stepped projection 151. In the latter there is an insert opening 152 for the corresponding free end section 146 of the arm 145. The projection 151 is surrounded by a frame 153 which rests on the bottom surface of the free space 107 and which is connected by screws 154 to the part of the slide on the outer side of the escutcheon. In order to reduce the friction between escutcheons 105, 106 and base plate 149 and the frame 153, slide plates 155 and 156 are provided.

Each slide 147 has a protruding actuating projection 157 located in the plane of the U-arm 109. In order that the actuating protection does not extend in a disturbing manner into the gripping space of the grip bar, the U-arms 109 are bent up to above one of the longitudinal edges of the escutcheon, see in particular FIGS. 21 and 22.

The following manner of operation results:

If the sliding door 101 which is equipped with the drive-rod lock of the invention is in its locked position, then the locking pins 139 engage in form-locked manner into the correspondingly shaped strike plates 141 on the frame side. The locking position of the drive-rod 117 is secured by the bolt 118 of the locking mechanism 114. The opening of the sliding door requires, first of all, an actuating of the lock cylinder so as to thereby bring the bolt 118 out of engagement. Thereupon, if the door is to be opened from the outside, the slide 147 on the outer side of the door must be displaced in upward direction. This is preferably done in the manner that the index finger acts on the actuating projection 157 while the thumb of the actuating hand rests on the upper U-arm 109. Together with the upward movement of the slide 147, the arm 145 is carried along, it, in turn, carrying along the coupling plate 142 and thus the drive-rod 117 in outward direction. Upon this movement, the force accumulator is loaded and the release is raised above the blocking edge where it engages. The locking pins also enter into such a position with respect to the strike plate that subsequent opening of the sliding door is made possible.

In the second embodiment, which is shown in FIGS. 24 to 30, identical structural parts have been given the same reference numbers. Also in this embodiment, the drive-rod lock is associated with a sliding door 101. It would, however, also be possible to develop the drive-rod arrangement in such a manner that it is suitable for a hinged door.

It can be noted from FIG. 24 that the locking mechanism 114 with its bolt 118 is inserted into a window 158 of the drive-rod 117 and thus blocks displacement of the drive-rod 117.

As in the previous embodiment, there is provided also in this case an escutcheon 159 on the outer side of the door and escutcheon 160 on the inner side of the door having a lock cylinder insert opening 112 in the lower region of the escutcheon. Each escutcheon 159, 160 has a slot 148 for guiding a region 150 which is stepped back from the base plate 149. The region 150 also continues into a projection 151 which is surrounded by a frame 153. Both the frame 153 and the base plate 149 consist of plastic so that additional slide plates can be dispensed with. The insert opening 152 is connected to the end section 146 of the arm 145 which is connected in the same manner to the drive-rod 117 via a coupling plate 142.

Differing from the first embodiment, the slide 147' is provided with a push-button shaft 161 which passes through the one U-arm 109' and is guided therein. Both U-arms 109' of the U-shaped grip 108' which is arranged on the escutcheon 159, 160 have a guide opening 162 for the push button shaft 161 passing through them.

FIG. 28 illustrates that the U-arms 109' are bent on the other side of the guide opening 162 to beyond the one longitudinal side edge 163 of the escutcheon 159, 160.

Figure 27:
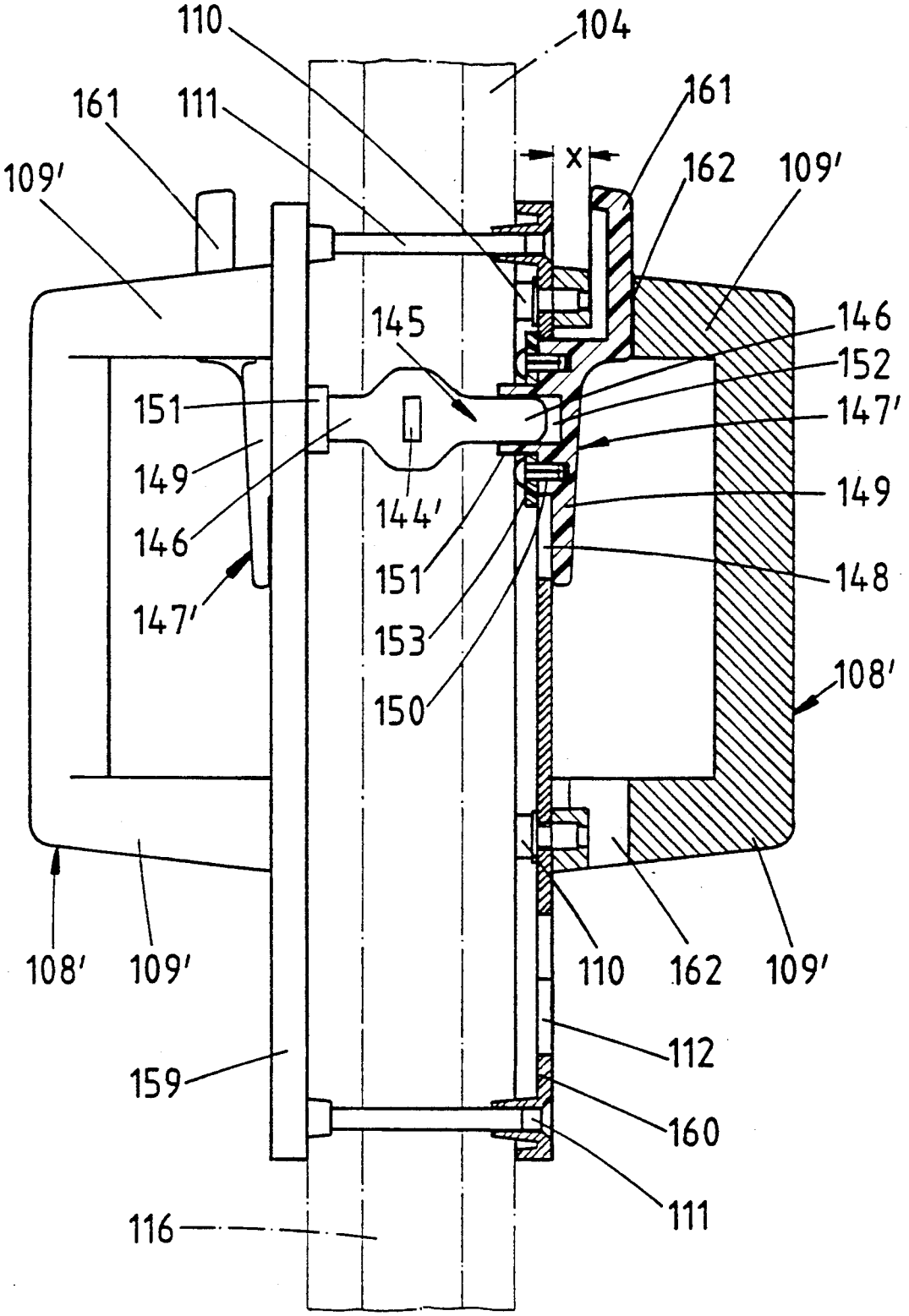
FIG. 27 shows, partially as outer view and partially in longitudinal section, the drive-rod lock in accordance with another embodiment.
Figure 29:
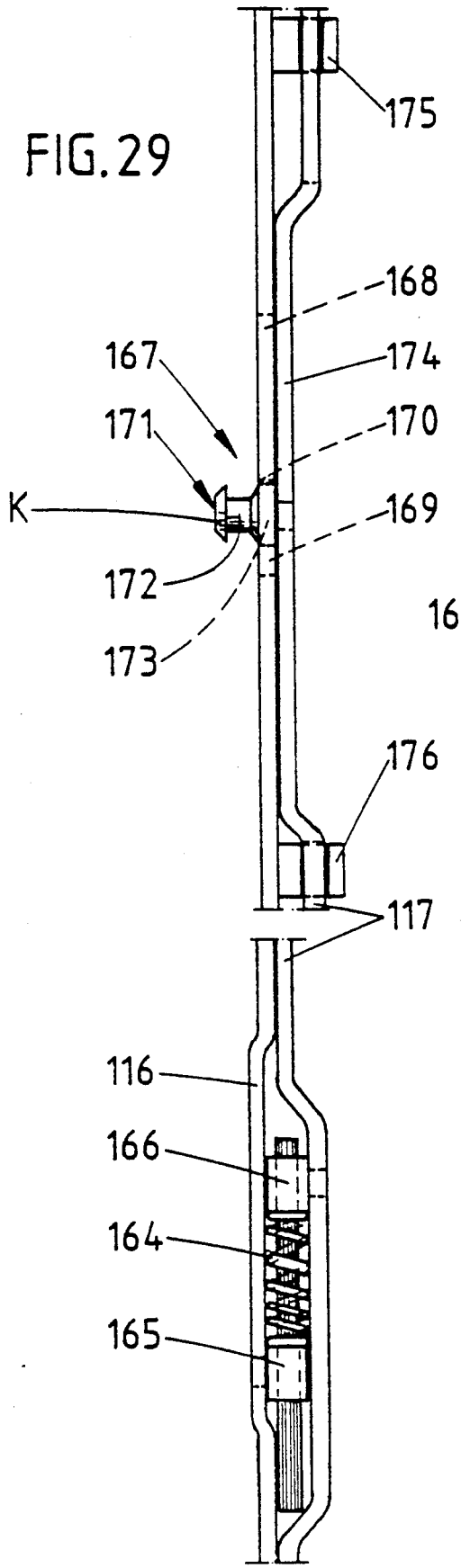
FIG. 29 shows the detent device with force accumulator associated with the embodiment according to FIG. 27

It can furthermore be noted in particular from FIGS. 27 and 28 that perpendicular to the escutcheon surface there is a distance x between the push button shaft 161 and the base plate 149 of the slide 147'. As FIG. 27 furthermore illustrates, the push button shaft 161 protrudes beyond the free end of the base plate 149 of the slide 147'.

In this embodiment also, a force accumulator 164 is present in the form of a compression spring below the lock mechanism 114. As support for the force-accumulator compression spring 164 there serves at the one end a projection 165 which is riveted to the cuff rail 116. At the other end, an abutment 166 is attached to the drive-rod 117 opposite the projection 165. In contradistinction to the first embodiment, the force accumulator 164 is loaded when the drive-rod 117 moves downward.

A detent device 167 arranged above the lock mechanism 114 serves to secure the loaded position of the force accumulator 164. The detent device has two slot sections 168, 169 of different width which lie one behind the other in the cuff rail 116 in the manner that in this case the upper slot section 1-68 has a smaller width. In this way, one blocking edge 170 each is formed at the transition point between the two slot sections 168, 169. A pin having a frustoconical head K serves as release member 171. The pin protrudes beyond the cuff rail. The diameter of the base corresponds approximately to the width of the slot section 169. A pin section 172 adjoins the head and has a diameter which is somewhat less than the width of the slot section 168. This pin section 172 continues into a pin section 173 which rests against the surface of the drive-rod 117 facing the cuff rail and which corresponds in its diameter to the width of the slot section 169. The drive-rod 117 forms, together with the region bearing the release member 171, a spreading spring 174. This spreading spring 174 is U-shaped, seen in longitudinal direction. Two spacers 175 and 176 serve to guide the drive-rod and the spreading spring 174 in the corresponding region thereof.

Figure 30:
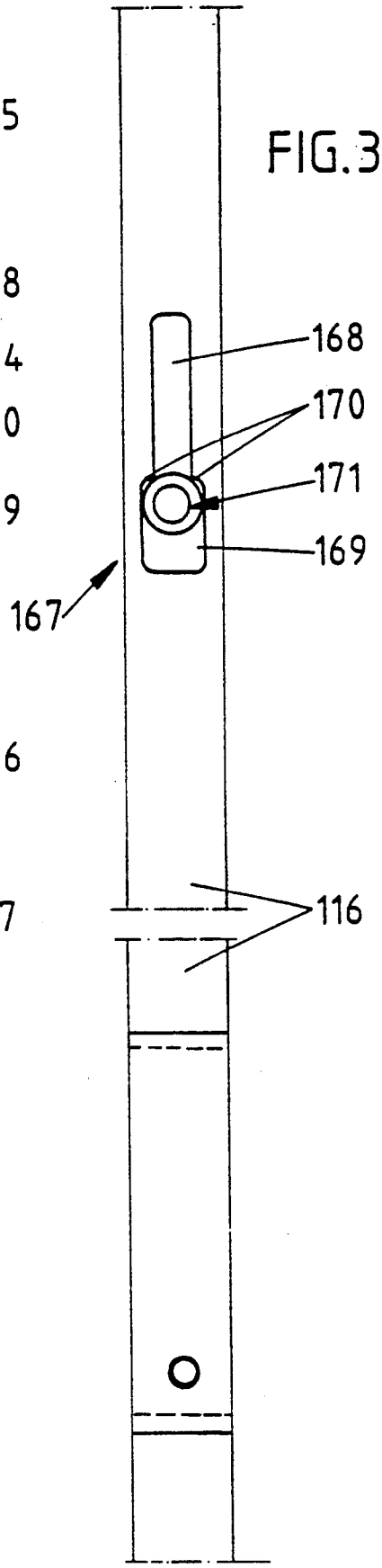
FIG. 30 is a rotated view of FIG. 29.

In the loaded position of the force accumulator 164, which corresponds to the open position of the sliding door, the pin section 173 engages through the slot section 169 and rests against the blocking edges 170; see FIG. 30. The force accumulator 164 can accordingly not unload. In this position there is present a stretched alignment of the spreading springs 174; see FIG. 29.

The unloaded position of the force accumulator 164 is the position which is present when the sliding door is closed. In this position, the spreading spring 174 is bent due to having previously been acted on and the pin section 173 rests on both sides of the slot section 168 of the cuff rail 116 against the latter. Furthermore, the locking pins 139 engage into the narrower slot section 177' of the strike plate 177 in the manner that the collar 140 engages behind the strike plate 177 and thus holds the door on the frame. In order to block a displacement of the drive-rod 117, the bolt 118 can be advanced into the position shown in FIG. 25. The opening of the sliding door requires that the bolt 118 be retracted. Thereupon, if the opening is to take place from outside the door, the push-button shaft 161 of the slide 147' which is guided in the escutcheon 159 must be urged in downward direction, together with a carrying along of the arm 145 and the drive-rod 117. During this movement, the locking pins 139 pass with their collar 140 into the wider slot section 177'' of the strike plate 177. At the same time, the force accumulator 164 is loaded by the downward displacement of the drive rod 117. Hand in hand with this, the release member 171 is carried along. As soon as the pin section 173 has entered into the wider slot section 169, the spreading spring 174 can restore itself with forward displacement of the release member 171 so that the pin section 173 then rests against the blocking edges 170. In this way, the loaded position of the force accumulator 164 is also secured. Subsequent opening of the sliding door is possible.

If the sliding door is closed with the force accumulator 164 loaded, then a stop on the frame side acts in the end phase of the sliding on the head K of the release member 171 so that the pin section 173 moves away from the blocking edges 170 with simultaneous bending of the spreading spring 174. The force accumulator 164 can then enter into action, it displacing the drive-rod 117 in upward direction while simultaneously establishing the engagement between the locking pins 139 and the strike plates 177 on the frame side. Via the coupling plate 142 and the arm 145, the slides 147 are also carried along, their push-button shafts 161 protruding above the upper U-arms 109 and thus indicating that the force accumulator 164 is unloaded.

I claim:

1. A drive-rod lock disposed on a door operative with a door frame having a strike plate, the lock including a handle and having a drive rod which is displaceable by displacement of the handle, the lock being covered by a cuff rail of the drive-rod lock and having locking member arranged in a region of freely protruding cuff-rail sections, the lock further comprising a force accumulator acting on the drive rod;

wherein upon a closing of the door, the locking members come into engagement with the strike plate on the door frame, the lock further comprises release means to accomplish a releasing of the force accumulator via action upon the release means by the door frame strike plate upon a closing of the door;

the release means and the force accumulator are arranged on a side of the freely protruding cuff-rail sections;

the lock includes a spring exerting a force upon the release means; and said release means extends through said cuff rail and protrudes beyond the cuff rail, the release means being actuatable against action of said spring in a direction perpendicular to the cuff rail while releasing the drive rod.

2. The drive-rod lock, according to claim 1, wherein said release means is moveable from a fixed position into a release position against a force of the drive rod, the drive rod extending with spring action along a side of the cuff rail.

3. The drive-rod lock, according to claim 1, wherein said cuff rail has a recess with a slot extending therefrom in a longitudinal direction of the cuff rail; and said release means comprises a pin which has a wide head, the diameter of the pin head being smaller than a width of the recess and larger than a width of the slot, the pin having an annular groove, the groove diameter being smaller than the width of said slot.

4. The drive-rod lock, according to claim 3, wherein the cuff rail has a blocking edge at a side of said recess;

said release means is held in a fixed position by the blocking edge.

5. The drive-rod lock according to claim 1, further comprising a plurality of spacers; and wherein the drive rod acts as a spreading spring, has a plurality of bends and is slidingly fastened to the cuff rail by means of said spacers, there being distances between said spacers corresponding to approximately 50 times the length of a stroke of said release means.

6. The drive-rod lock, according to claim 3, wherein the head of said release means is formed as a truncated cone.

7. The drive-rod lock, according to claim 1, wherein said strike plate has a run-on bevel for contacting said release means.

8. The drive-rod lock, according to claim 1, wherein a part of the drive rod acts as a spreading spring and rests in fixed position against the cuff rail.

9. The drive-rod lock, according to claim 5, wherein at least one of the cuff rail sections and at least one of the bends of the drive rod form a location for receiving the force accumulator, the force accumulator comprising a compression spring.

10. The drive-rod lock, according to claim 1, further comprising a first slide, an auxiliary slide having a mandrel and intersecting the first slide, a compression spring, and an actuating arm having a claw-shaped end;

a coupling pin clamped by the compression spring against the actuating arm, and located between said actuating arm and the auxiliary slide;

wherein said coupling pin clamps the claw-shaped end of said actuating arm against an end surface of said first slide; and said compression spring is seated on the mandrel of said auxiliary slide, said mandrel extending through an inside of said first slide and engaging over said coupling pin as a yoke.

11. The drive-rod lock according to claim 10, further comprising a lock housing having a slot and enclosing said first slide and said auxiliary slide;

a plurality of stops disposed in said lock housing;

wherein said first slide receives a part of a length of said compression spring, and said coupling pin is guided by said first slide in the slot of the lock housing, movement of the first slide being limited by said stops; and one of said stops has a mating stop edge for engaging with said first slide and lies opposite a stop edge of said housing slot.

12. The drive-rod lock according to claim 10, further comprising a nut for receiving the door handle, and a link plate;

wherein said actuating arm comprises two arms, one of said two arms being coupled to the nut via the link plate.

13. The drive-rod lock according to claim 10, wherein said compression spring is adjustable by adjustment of a length of the mandrel.

* * * * *